United States Patent [19]

Kohnhorst et al.

[11] 4,210,157

[45] Jul. 1, 1980

[54] SMOKABLE TOBACCO PRODUCTS

[75] Inventors: Earl E. Kohnhorst, Louisville; Thomas W. Summers, Fern Creek; David L. Gordon, Louisville, all of Ky.

[73] Assignee: Brown & Williamson Tobacco Corporation, Louisville, Ky.

[21] Appl. No.: 869,736

[22] Filed: Jan. 16, 1978

Related U.S. Application Data

[63] Continuation-in-part of Ser. No. 721,138, Sep. 9, 1976, abandoned.

[51] Int. Cl.[2] ..... A24D 1/00; A24B 3/14; A24B 1/02

[52] U.S. Cl. ..... 131/8 R; 131/20 R; 131/140 R

[58] Field of Search ..... 131/14, 8 R, 1, 2, 8, 131/9, 140 R, 140 U, 17, 81 R, 81 A, 31, 62, 79, 109 B, 110; 162/55, 91

[56] References Cited

U.S. PATENT DOCUMENTS 4,074,722 2/1978 Kohnhorst ..... 131/8 R

FOREIGN PATENT DOCUMENTS 139007 4/1964 New Zealand ..... 131/8 R

*Primary Examiner*—Robert W. Michell
*Assistant Examiner*—Thomas Wallen
*Attorney, Agent, or Firm*—Charles G. Lamb; William J. Mason

[57] ABSTRACT

Disclosed is a smokable tobacco product comprised of a tobacco portion consisting essentially of tobacco particles having a mean ratio of area to perimeter squared of at least about 0.049 and a short dimension not in excess of 0.5 inch wherein the particles are of a substantially normal particle size distribution. By forming a smokable tobacco product of such particles, the lattice structure is highly resilient, enabling product formation at lower than normal weights while retaining similar firmness, end stability and burn properties as conventional cigarettes.

5 Claims, 1 Drawing Figure

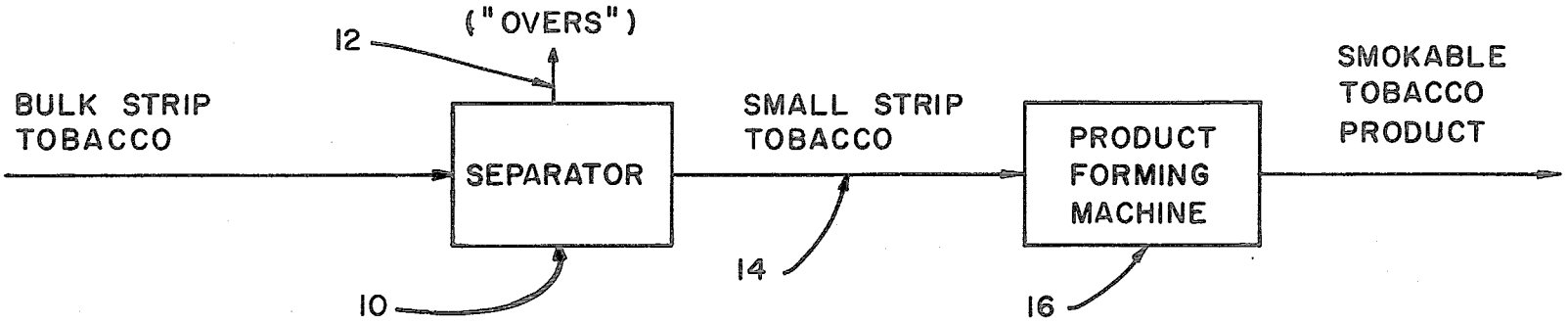
BULK STRIP TOBACCO
("OVERS")
12
SEPARATOR
10
SMALL STRIP TOBACCO
14
PRODUCT FORMING MACHINE
16
SMOKABLE TOBACCO PRODUCT

SMOKABLE TOBACCO PRODUCTS

RELATED APPLICATIONS

This is a continuation-in-part of U.S. Ser. No. 721,138, filed Sept. 9, 1976, now abandoned.

BACKGROUND OF THE INVENTION

The present invention relates to smokable tobacco products and particularly relates to smokable tobacco products having improved properties.

The cost of raw tobacco has increased substantially in recent years to the extent that it has become an increasingly larger percentage of the overall cost of the smokable tobacco products. Efforts to better utilize tobacco raw materials and also to improve the final smokable tobacco product are thus becoming increasingly important. While it is desirable to provide a smokable tobacco product which may be formed of a lesser quantity of tobacco than utilized in conventional tobacco products, it is necessary to simultaneously retain and improve traditional product characteristics such as firmness; end firmness or stability; coal retention; density; pressure drop; number of puffs, etc.

Cigarettes are conventionally formed by threshing raw tobacco and cutting the threshed tobacco to reduce its size for handling by the tobacco product making or forming machine. Tobacco products formed by this traditional method utilizing cut tobacco are characterized by cut tobacco particles which are generally planar two dimensional structures each having a small roughly constant width and a variable dimension in length. The major axis of each traditionally cut tobacco particle in the conventional cigarette runs approximately parallel to the length of the cigarette tube. Once a particle obtains a certain length, little benefit in increased firmness in the cigarette is obtained by increasing the length of the particle. Thus, a limit is reached in conventional cigarettes where, for a specified firmness, a particular density or amount of tobacco is necessary.

SUMMARY OF THE INVENTION

The present invention provides a novel and improved smokable tobacco product having improved properties and which improvements are based primarily on differences in tobacco particle geometry, size distribution, and orientation in comparison with traditional smokable tobacco products formed from cut tobacco. It has been found that use of small strip tobacco particles as defined hereinafter permits the formation of smokable tobacco products, e.g., cigarettes, at lower than normal weight, i.e., lower density of tobacco, while retaining properties such as firmness, end stability and pressure drop in comparison to conventional smokable tobacco products.

The term "small strip tobacco" as used herein refers to tobacco, including reconstituted tobacco, particles having a mean ratio of area to perimeter squared ($A/P^2$) of at least about 0.049. Normally, at least 70% of the particles present in the smokable tobacco product will have an $A/P^2$ ratio of from about 0.037 to about 0.065.

In addition, the particles of tobacco of the present invention may be characterized as irregular pieces having a short dimension not in excess of 0.5 inch, and preferably not in excess of 0.365 inch. The particles may be further characterized as having a short dimension defined by an arithmetic mean size of at least 1.93 mm and a geometric mean size of at least 1.74 mm and are of a substantially normal particle size distribution.

The utilization of small strip tobacco as a minor component in cigarettes is disclosed in commonly assigned U.S. Application Ser. No. 679,710, filed Apr. 23, 1976, by Kohnhorst. In that application, a process is disclosed which comprises separating small strip tobacco from bulk strip tobacco prior to cutting of the bulk strip tobacco and then reintroducing the small strip tobacco into the process line downstream from the cutting zone, but prior to cigarette formation.

According to a preferred aspect of the present invention, small strip tobacco is removed from bulk strip tobacco in a manner similar to that disclosed in Ser. No. 679,710. For example, small strip tobacco can be removed by screening the bulk strip tobacco, the tobacco particles passing through the screen and thereby being of predetermined size constituting the small strip tobacco. Contrary to the disclosure of Ser. No. 679,710, however, this small strip tobacco is then processed in conventional cigarette forming or making machines to form the novel and improved cigarettes or smokable tobacco products of the present invention in which the tobacco portion consists of small strip tobacco.

Furthermore, in New Zealand Pat. No. 139,007, dated Apr. 8, 1964, a cigarette product containing tobacco particles of a specific size as well as a process for production is disclosed. In the patent, the particles in the product are of a "substantially uniform size" distribution "preferably ¼ inch or less" with particles of a size smaller than ⅛ inch "not occuring in more than a very minor proportion". In the present invention, particles range as high as 0.5 inches and preferably up to 0.365 inches and particles less than ⅛ inch occur in a substantial proportion. In fact, the mean size (50% of particles on either side) is generally about 1.93 mm (about 1/12 inch). Thus, the particles of the present invention are of a "normal size" distribution.

One of the principal benefits derived from the formation of an all small strip cigarette or smokable tobacco product is the increased fill value of the small strip particles which results in increased firmness and consequent reduction in tobacco material utilized in forming the product. This is attributable to the tobacco particle geometry, size distribution, and orientation within the cigarette tube. As noted previously, the tobacco utilized in the all small strip cigarette has a particle size with a short dimension not in excess of about 0.5 inch. A substantial majority of the small strip tobacco particles have a shape approximating planar polygons. Also, 70–80% of the particles of small strip tobacco have a shape factor ($A/P^2$) substantially within a range of about 0.037 to about 0.065 wherein A is the area of the particle and P is its perimeter. It is believed that particles of this size and shape exert greater force on the retaining cigarette tube or wrapper than traditional cut tobacco exerts on its tube. This interaction between the particles is believed to be the cause of the greater end stability and firmness of the products. Additionally, the orientation of the small strip tobacco particles within the tube provides a lattice which is highly resilient. That is, in forming the cigarette rod or tube, the small strip particles conform to the curvature of the cigarette rod. Since the small strip particles have major dimensions both parallel to the tube length and concentric with the tube centerline, the lattice thus formed interacts to increase firmness. This is accomplished without decrease in smoking properties, i.e., pressure drop, end stability, puffs, etc. A significant result achieved by forming smokable tobacco products or cigarettes from the all small strip particles in accordance with the present invention is a substantial reduction in the tobacco weight, i.e. on the order of about 20 percent, while still producing a cigarette or smokable tobacco product with normal physical and smoke properties.

Accordingly, it is a primary object of the present invention to provide novel and improved smokable tobacco products.

It is another object of the present invention to provide novel and improved smokable tobacco products characterized by increased utilization of tobacco raw materials.

It is still another object of the present invention to provide novel and improved smokable tobacco products characterized by particles having a specified geometry, distribution and orientation resulting in improved firmness.

It is a still further object of the present invention to provide novel and improved smokable tobacco products containing a significant reduction in tobacco material in comparison with conventional tobacco products while retaining normal physical and smoke properties.

These and other aspects of the invention will become more apparent upon reference to the following specification, appended claims and drawing, which is a schematic flow diagram of a process for manufacturing smokable tobacco products in accordance with the present invention.

DETAILED DESCRIPTION OF PREFERRED EMBODIMENT

Referring to the drawing FIGURE, there is schematically illustrated a process for the manufacture of an improved smokable tobacco product in accordance with the present invention and including a separator generally indicated 10. Separator 10 may include a screen over which cased or bulk strip tobacco from a source, not shown, is passed. As amplified hereinafter, the small strip tobacco is removed as the material passes through screen 10. The "overs" or bulk strip tobacco which does not pass through the screen as small strip tobacco is removed along flow path 12 by a suitable mechanism. After the small strip tobacco is separated from the bulk strip tobacco by separator 10, it is conveyed along a flow path 14 toward the tobacco product making machines, schematically illustrated at 16. The equipment 16 for manufacturing the smokable tobacco product is conventional, and further description thereof is not believed necessary. The resulting product, however, as apparent from this description, is made entirely or wholly from the small strip tobacco.

The small strip tobacco utilized in the product making machinery thus comprises the small strip tobacco contained in the bulk strip tobacco after it has been threshed. Small strip tobacco, however, may be formed or generated by suitable processes, for example by a hammer-mill, or by classification through elutriation, particle trajectory or sizing screens to the size, shape and other specifications of the small strip obtained by screening bulk strip tobacco. The drawing figure, therefore, illustrates a process for forming cigarettes from all small strip tobacco which is preferably obtained by screening small strip tobacco from bulk strip tobacco. It will be appreciated that small strip tobacco separated from bulk strip tobacco, or generated by the aforementioned and other processes, may also be directly supplied to the product forming machines 16 to form the final smokable tobacco products of the present invention.

As previously noted, it has been found that improved properties of the final smokable tobacco product are obtained by providing tobacco particles of a size having a short dimension not in excess of about 0.5 inch. Preferably, however, small strip particles having a short dimension not in excess of about 0.365 inch are separated from the bulk strip tobacco by screening through a $2\frac{1}{2}$ mesh per inch square opening screen with an 83.3 percent open area. Further, it has been found that such improved properties are obtained by providing small strip tobacco comprised of particles having an arithmetic mean size of at least 1.93 mm and a geometric mean size of at least 1.74 mm. The density of the small strip tobacco is substantially the same as the density of cut tobacco and has a density of at least 0.6603 gm/cc.

The bulk small strip particle size is given in terms of a specified size of opening in a screen. The size of the particle provided is the significant factor rather than the process or apparatus used to obtain the small strip particles. It has been found that small strip tobacco may be characterized by a particle size distribution curve which is typically substantially symmetrically bell-shaped. Thus, the particle size distribution of small strip tobacco is unexpectedly, approximately normal. In comparison, the particle size distribution curve for traditional cut tobacco particles is typically log normal and has significant skewness.

Small strip tobacco is also classified according to its shape. To accomplish this, a form factor ($A/P^2$) has been chosen where A is the area of the substantially planar particle and P is its perimeter. The following Table illustrates a comparison of the form factor ($A/P^2$) distribution for small strip tobacco and traditional cut tobacco in terms of their means, standard deviation, skewness and kurtosis.

TABLE I

| | Small Strip Tobacco | Cut Tobacco (30 cpi) |
|---|---|---|
| Mean ($A/P^2$) | 0.049 | 0.034 |
| Standard Deviation | 0.012 | 0.015 |
| Skewness | −0.95 | 0.08 |
| Kurtosis | 4.07 | 2.35 |

As evident from Table I and as distinguished from traditional cut tobacco, small strip tobacco particle shape has a mean form factor ($A/P^2$) of at least 0.049. Also, from the mean values of ($A/P^2$) given in Table I, the shape of small strip tobacco can be approximated by rectangles with sides a, 0.38a; whereas cut tobacco particles appear as rectangles with sides a, 0.19a. The standard deviation in Table I demonstrates that most small strip tobacco particles appear as rectangles with sides ranging from a, 0.22a up to a, 0.73a. Most traditional cut tobacco particles, in contrast, appear within a range from a, 0.09a up to a, 0.37a. The skewness value of the small strip shape factor distribution from Table I shows that the ($A/P^2$) values of small strip particles are shifted toward rectangles of sides a, 0.37a and larger. On the other hand, the skewness value for cut tobacco indicates a symmetric distribution of shape factor ($A/P^2$) about the mean.

From the kurtosis values, the small strip tobacco shape factors and, hence, the shape distribution of the small strip particles are more likely to be found in a narrow range of values; distribution of cut tobacco particles lie over a wide range of values.

As calculated from data given in Table I, at least 70% of cut tobacco particles will have a shape factor ($A/P^2$) within the range of 0.019–0.049, while at least 70% of the small strip tobacco particles will thus have a shape factor ($A/P^2$) no greater than about 0.065 or no less than about 0.037. It is noted that the shape factor for traditional cut tobacco at the high end of its range has a value of 0.049, which value corresponds identically to the mean shape factor for small strip tobacco given in Table I.

Properties of the smokable tobacco product formed in accordance with the present invention, utilizing the processes described above, will now be set forth on a comparative basis with a current production cigarette. The small strip samples identified in Table II below were obtained using the process according to the Figure. In general, bulk strip tobacco used in commercial manufacturing operations was separated by screening. Small strip tobacco was removed as the material passed through a 3 mesh (0.286" opening) screen. The small strip tobacco was conditioned to 13–14% moisture. Finally, cigarettes were fabricated from the all small strip tobacco passed through the screen. In fabricating the cigarettes, the density was targeted for the A and B samples at 20% and 10% reductions, respectively, from the density of standard production cigarettes. The C sample represents a cigarette made from all small strip tobacco at substantially the same density as the production cigarette.

The test results are set forth in Table II and are shown on the basis of percentage improvement for each sample compared to the production cigarette.

The following definitions are provided to facilitate interpretation of these test results:

Tobacco Section Pressure Drop—the resistance to air flow in the tobacco rod measured in inches of water pressure loss.

Firmness—the ability of a cigarette to withstand an applied compressive force.

End Stability—the measure of a cigarette's resistance to form void, loose, or soft ends.

Coal Retention Probability—the ability of a cigarette to retain its coal for a specified duration of tapping.

TABLE II

PHYSICAL AND SMOKE PROPERTIES OF ALL SMALL STRIP CIGARETTES AS PERCENTAGE OF IMPROVEMENT RELATIVE TO A PRODUCTION CIGARETTE

| Cigarette Code Type | A Small Strip[1] | B Small Strip[1] | C Small Strip[1] |
|---|---|---|---|
| Density change Relative to Density of Standard Production Cigarette | −17.9 | −10.8 | −2.4 |
| Firmness[2] | 0[3] | 13.8 | 30 |
| End Stability | 53 | 75 | 83 |
| Coal Retention Probability | 0[3] | 19.6 | −7 |
| Tobacco Section Pressure Drop (in $H_2O$) | 0[3] | 22 | 94 |
| Puffs | 0[3] | 10 | 15 |
| Tar Delivery | 0[3] | −10 | −9 |
| Nicotine Delivery | 5 | −8 | 6 |

[1] All small strip cigarette made from −3 mesh small strip
[2] Corrected for moisture
[3] No Significant Change From the foregoing Table II, it can be seen that the sample C made at normal density had improved firmness of 30% while sample B made at 10% reduced density had improved firmness of 13.8%. Note that sample A having a 20% reduced density had substantially equal firmness with the production standard cigarette. Improvements of 53%, 75%, and 83% in end stability for samples A, B and C relative to the production standard cigarette are also shown. The sample B obtained a 19.6% improvement in coal retention probability while sample A had no significant change in its coal retention probability in comparison with the coal retention probability of the production standard cigarette. Thus, the coal retention probability decreased as density decreased.

The tobacco section pressure drop also decreased as density decreased and a leveling off effect was obtained at about the density obtained in sample A.

Smoking properties also changed with respect to density changes. The puffs increased virtually linearly with increase in density. Sample A had no significant change in the number of puffs delivered in comparison with the production standard cigarette. With respect to tar, nicotine and CO deliveries, it was noted that the sample A did not change substantially from the production standard cigarette.

A sample was also fabricated at 30% reduced density from production standard cigarette density and tested for the properties listed in Table II. The properties of this sample were inferior to the production standard cigarette, especially firmness. Thus, it is believed that the best balance of desirable features may occur at about a 20 to 25% density reduction, when practicing the invention as described herein.

It is believed that the foregoing properties disclosed in Table II enabling density reduction, while retaining physical, chemical and smokable properties comparable to standard cigarettes, are attributable, not only to the small strip tobacco particle size and distribution, but also at least in part to their shape and orientation within the tobacco rod. That is, the small strip tobacco particles have a major dimension extending parallel to the axis of the rod and also a major dimension running concentric with the rod's centerline. The natural resiliency of these particles arranged in the foregoing manner provides increased firmness without causing large pressure drops. It has also been found that the pressure drop variance is smaller as compared with the production standard cigarettes although it is elevated slightly.

It is apparent from the foregoing specification that the objectives set forth are fully achieved. Principally, there is provided a smokable tobacco product using entirely as the tobacco component small strip tobacco in which the product may be formed from a lesser quantity of tobacco while simultaneously retaining substantially like physical, chemical and smokable properties as standard conventional cigarettes. Thus, greater utilization of raw tobacco material is achieved through the manufacture of cigarettes containing entirely all small strip tobacco.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

While the present invention has been described in terms of a smokable tobacco product in which the tobacco portion is formed from small strip tobacco, as previously defined, it is to be appreciated that the smokable tobacco product may contain minor amounts of other additives, such as casings, flavorants, and the like.

It is claimed:

1. An improved smokable tobacco product comprised of tobacco surrounded by a cylindrical wrapper in which said tobacco portion consists essentially of tobacco particles having a mean ratio of area to perimeter squared of at least about 0.049, a short dimension not in excess of 0.5 inch, and an arithmetic mean size of at least 1.93 mm, said particles being of a substantially normal particle size distribution.

2. The product of claim 1, wherein at least 70% of said particles have a mean ratio of area to perimeter squared of from about 0.037 to about 0.065.

3. The product of claim 1, wherein said tobacco particles have a short dimension not in excess of 0.365 inch.

4. The product of claim 1, wherein said tobacco particles have a short dimension characterized by an arithmetic mean size of at least 1.93 mm and a geometric mean size of at least 1.74 mm.

5. The product of claim 1, said tobacco particles being from uncut tobacco.

* * * * *